United States Patent [19]

Scully

[11] Patent Number: 4,796,366

[45] Date of Patent: Jan. 10, 1989

[54] PLOW/SCRAPER ASSEMBLY FOR EARTH MOVER VEHICLE

[76] Inventor: Robert M. Scully, 39290 Tunstall Dr., Mt. Clemens, Mich. 48044

[21] Appl. No.: 20,046

[22] Filed: Feb. 27, 1987

[51] Int. Cl.[4] ..... E02F 3/65; E02F 3/815

[52] U.S. Cl. ..... 37/4; 37/117.5; 172/815

[58] Field of Search ..... 37/124, 4, 117.5, 118 A, 37/126, 126 A, 126 AA, 126 AB; 172/811, 831, 815, 830, 8

[56] References Cited

U.S. PATENT DOCUMENTS

| | | | |
|---|---|---|---|
| 2,635,884 | 4/1953 | Christiansen | 37/117.5 X |
| 2,795,872 | 6/1957 | Wardle | 37/4 |
| 3,038,265 | 6/1962 | Hunger | 172/831 X |
| 3,092,919 | 6/1983 | Reynolds | 37/124 X |
| 3,094,794 | 6/1963 | Wardel | 37/4 |
| 3,105,311 | 10/1963 | Hait | 37/4 |
| 3,209,475 | 10/1965 | Salna | 37/117.5 |
| 3,406,848 | 10/1968 | Zinc | 37/4 |
| 3,975,844 | 8/1976 | Olson | 37/117.5 |

FOREIGN PATENT DOCUMENTS

| | | | |
|---|---|---|---|
| 1960285 | 12/1978 | Fed. Rep. of Germany | 172/811 |
| 2227399 | 11/1974 | France | 37/117.5 |
| 915640 | 1/1963 | United Kingdom | 37/117.5 |

*Primary Examiner*—Richard J. Johnson

*Attorney, Agent, or Firm*—Peter A. Taucher; David L. Kuhn

[57] ABSTRACT

An earth mover vehicle is equipped with a novel blade structure at the mouth end of an earth-containment bowl structure. The blade is adjustably attached to the vehicle so that it can alternately function as a closure for the bowl structure, or as an earth load-unload ramp, or as an earth bulldozer (scraper or plow).

18 Claims, 6 Drawing Sheets

PLOW/SCRAPER ASSEMBLY FOR EARTH MOVER VEHICLE

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to an earth-mover vehicle that can perform the functions of plowing, grading, scraping, hauling and dumping.

The vehicle includes a bowl structure designed to contain loose earth, sand, gravel, etc. for hauling purposes or for ballast (when the vehicle is performing a plowing function). The rear side of the bowl is closed by a door that can be swung down to act as a ramp.

A bulldozer blade is hingedly attached to an edge of the door so that when the door is acting as a ramp an edge of the blade functions as a shovel to guide loose earth onto the door (ramp) surface. With the door swung down to its "ramp" position the vehicle can be moved to cause the blade (shovel) to advance into hard terrain. The leading edge of the blade lifts the loosened earth from the terrain. As the vehicle proceeds the loosened earth is pushed onto the ramp (door) and thence into the bowl.

The bowl is equipped with a conventional ejector plate. Earth, gravel, etc. can be discharged from the bowl by advancing the ejector plate longitudinally within the bowl cavity. Earth discharge takes place through the open end of the bowl and over the ramp surface.

When the bulldozer blade is adjusted to perform a plowing function the door functions as a link between the vehicle and the blade. The blade depth-of-cut can be adjusted by swinging the door (link) up or down around its point of attachment on the vehicle.

The vehicle is designed so that when the door is closed it has a sealed water-tight connection with the bowl structure. The vehicle can be used by the military for various earth-mover functions, e.g., creating anti-tank ditches, removing obstacles in the path of the troops, and forming placements for infantry, artillery or armor. When used by the military the vehicle is designed to:

1. be sufficiently light weight for air transportability purposes.
2. have an earth-containment bowl that effectively increases the vehicle weight when traction is needed.
3. perform relatively heavy bulldozing (plowing) functions.
4. have a water-tight bowl structure to enable the vehicle to ford streams and perform swimming operations.

THE DRAWINGS

Figure 1:
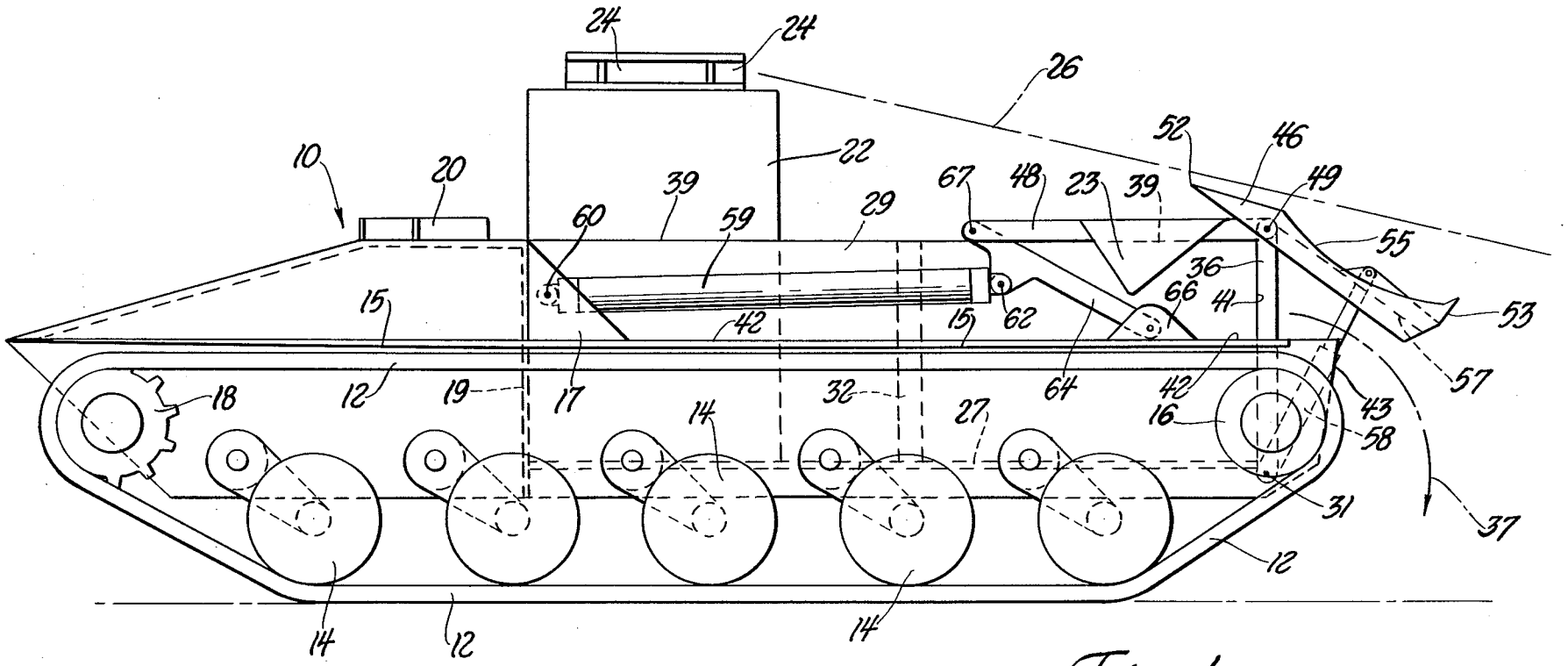
FIG. 1 is a side elevational view of vehicle embodying my invention.
Figure 2:
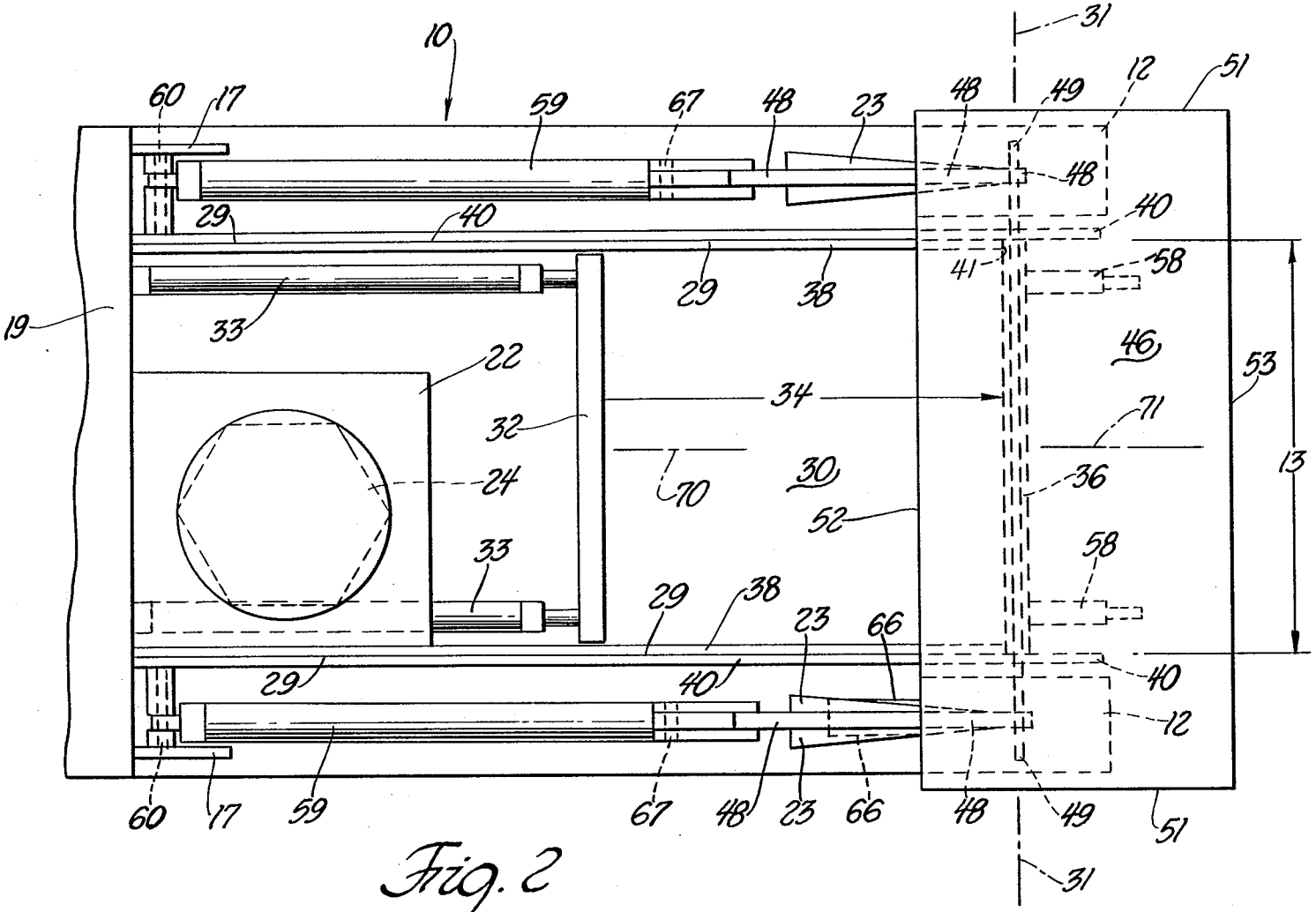
FIG. 2 is top plan view of the FIG. 1 vehicle.

Referring in greater detail to FIGS. 1 and 2, there is shown a tracked vehicle 10 having endless tracks 12 trained around road wheels 14, rear idler wheels 16, and front sprocket wheels 18. Fenders 15 may be provided over the upper runs of tracks 12.

The vehicle power plant (engine and transmission) is located in the front section of the vehicle (forwardly from transverse bulkhead 19) to provide power to sprocket wheels 18. The human driver is seated in the vehicle alongside the power plant so that he can view the terrain through vision blocks 20.

The area behind the driver station contains a commander's cupola 22 equipped with vision blocks 24. Preferably the vision blocks are of sufficient height as to permit the commander to view the area behind the vehicle, e.g., along sight line 26.

BOWL STRUCTURE

A false bottom wall 27 extends from bulkhead 19 to the rear end of the vehicle. Vehicle side walls 29 (FIG. 2) cooperate with bottom wall 27 to partially define an earth-containment bowl structure 30. The front wall of the bowl is defined by a transversely-extending ejector plate 32 that can be moved in a rearward direction (from its FIG. 2 position) to push earth out of the bowl.

Any suitable power mechanism can be employed to operate ejector plate 32, e.g., rack and pinion units or ball screw units. As shown in FIG. 2, the operating mechanism takes the form of hydraulic cylinders 33. The stroke distance of the ejector plate is designated by numeral 34.

The rear (open) end of bowl structure 30 is closed by a door 36 that is hingedly connected at its lower end to side walls 29 for arcuate motion around pivot axis 31 (FIG. 1). The door can move around axis 31 in an arc 37 (to the FIG. 4 position).

Each side wall 29 of the bowl structure is defined by an inner plate 38 and an outer plate 40. Each inner plate 38 has an upper edge 39 and a rear edge 41. Each outer plate 40 has an upper edge 42 and a rear edge 43. Door 36 is dimensioned to occupy the space between plates 40. In its closed (FIG. 1) position the door abuts against the rear edges 41 of plates 38. Gaskets may be provided on edges 41 and/or the registering areas of door 36 to provide sealed (water-tight) joints between the door and the bowl structure.

Figure 5:
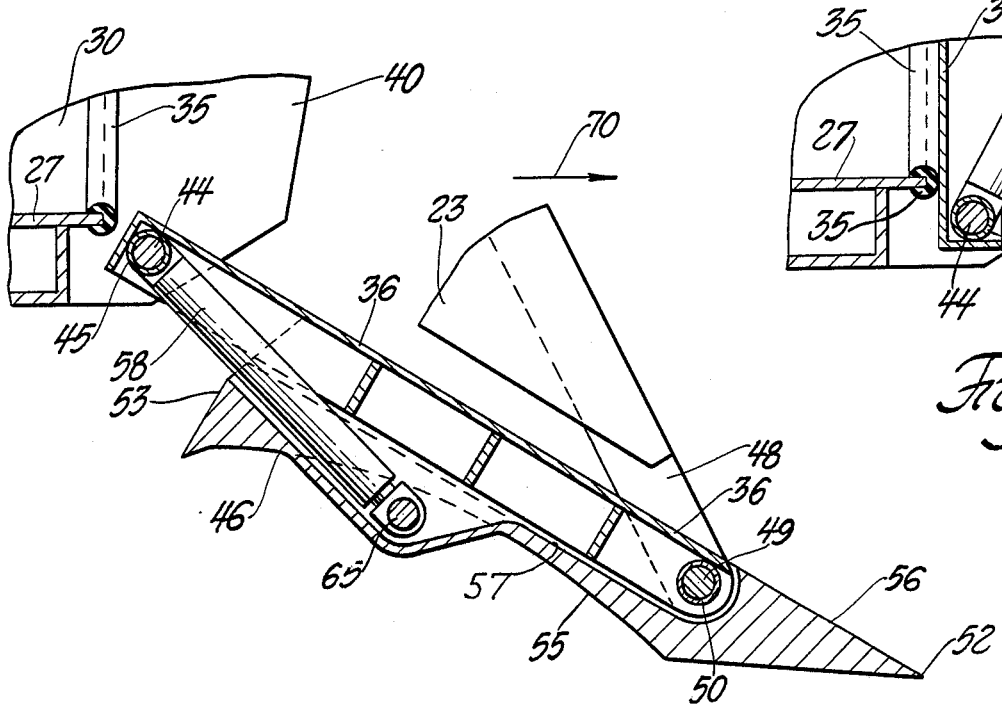
FIG. 5 is an enlarged sectional view taken through a door-blade assembly used in the FIG. 1 vehicle.
Figure 6:
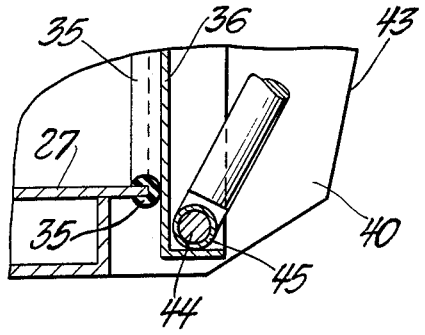
FIG. 6 is a fragmentary view in the same direction as FIG. 5, but with the door adjusted to a different position (closing the bowl structure).

FIGS. 5 and 6 illustrate one possible gasket arrangement that can be employed. As there shown, the rear edges of false floor 27 and plates 38 are provided with elastomeric gaskets 35. When the door is closed (FIG. 6) the door face engages the gasket to provide a water-tight joint between the door and the bowl structure.

DOOR 36 STRUCTURE

Door 36 may comprise a rectangular steel plate having reinforcement edge flanges and internal bracing ribs, as shown generally in FIG. 5. In its FIG. 1 position the door acts as a closure for the open rear end of the earth-containment bowl structure. When the door is swung down to the position shown in FIG. 4 and 5 it acts as a ramp to support earth being conveyed into (or out of) bowl structure 30. The door must be of relatively heavy construction in order to withstand loads incident to earth loading/unloading operations.

The hinge connection between the door and the bowl structure may be varied as to detail. FIG. 5 contemplates the use of an elongated shaft 44 extending between plates 40; the ends of the shaft may be welded to plates 40. Door 36 may have sleeve sections 45 welded thereto for rotary motion on shaft 44.

The upper (outer) edge of door 36 has hinged connections with a bulldozer blade 46 and link members 48. A shaft 49 extends within the blade through an elongated sleeve 50 carried by door 36 (FIG. 5). The length of shaft 49 may be visualized from FIG. 2.

The sleeve 50 - shaft 49 assembly forms a hinged connection between the door and blade 46. Additionally, shaft 49 forms hinged connections between blade 46 and link members 48.

BULLDOZER BLADE 46

Figure 3:
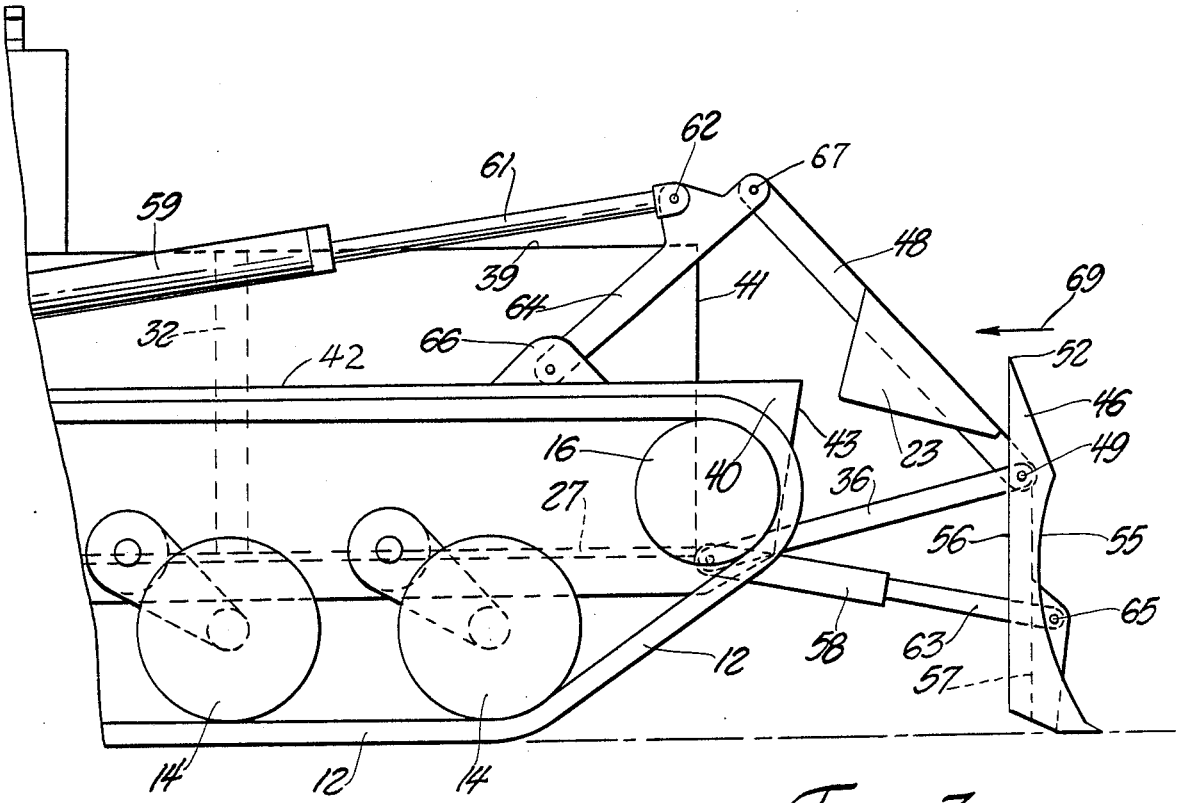
FIGS. 3 and 4 are fragmentary views taken in the same direction as FIG. 1, but showing certain components (door and bulldozer blade) in different positions of adjustment.

Blade 46 takes the form of a heavy steel plate of rectangular outline (as seen in FIG. 2). The plate has side edges 51, a first transverse edge 52, and a second transverse edge 53. The front face 55 of the blade has a concave curvature to facilitate its use for earth mover purposes (FIG. 3 position). The blade rear face 56 has a rectangular recess (cavity) 57 therein adapted to receive door 36 (when the components are in the FIG. 5 position). Recess 57 is enlarged at certain points to accommodate (receive) hydraulic cylinder units 58. The locations of the hydraulic cylinders can be visualized from FIG. 2. Contours on the recess enlargements can be visualized from FIG. 5.

ADJUSTMENT MECHANISM FOR DOOR 36 AND BLADE 46

Figure 4:
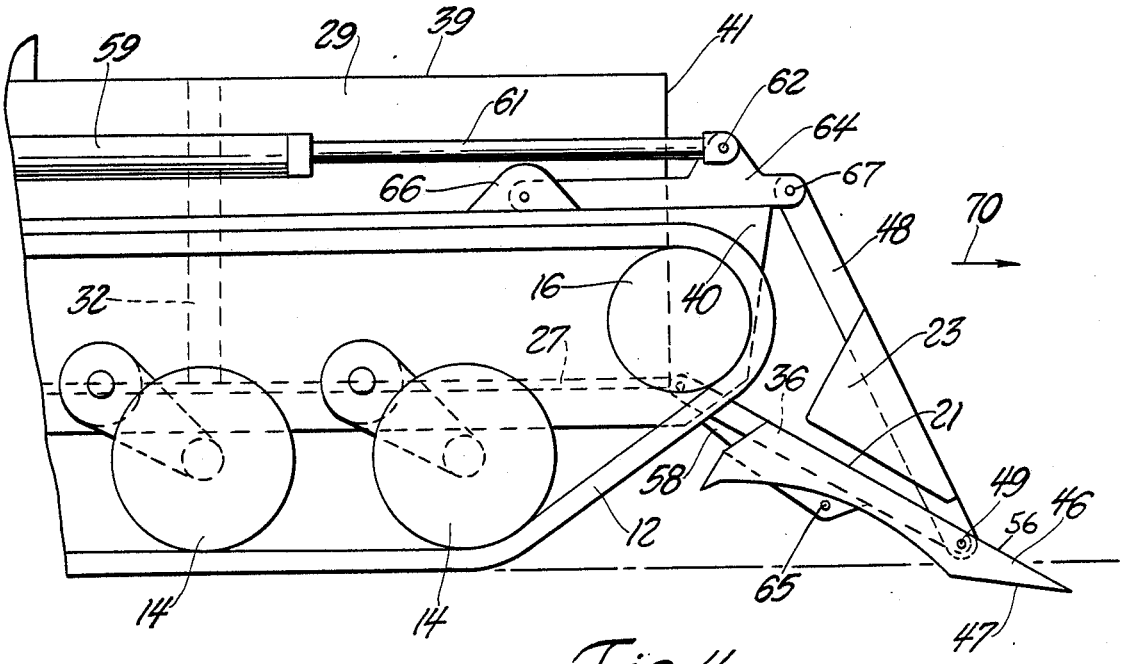

Door 36 can be adjusted between a raised position (FIG. 1) and a fully lowered position (FIG. 4). The door adjustment mechanism comprises two laterally spaced hydraulic cylinders 59 (FIGS. 1 and 2) having their forward ends swingably connected to anchorages 60. Each anchorage 60 comprises a transverse shaft extending between vehicle side wall 29 and a stationary plate 17. The piston rods 61 for cylinders 59 have pivotal connections 62 with links 64 that are swingably mounted on stationary brackets 66. The aforementioned link members 48 have pivotal connections 67 with links 64.

In the FIG. 1 position of the componentry, piston rods 61 are retracted into cylinders 59. Door 36 is in an upright (closed) position. Introduction of pressurized liquid into the left (forward) ends of cylinders 59 moves the components to the FIG. 3 position. Blade 46 can then be used for plowing (bulldozing) operations. The depth of the blade can be adjusted by feeding/withdrawing fluid into/out of cylinders 59.

When blade 46 is in the FIG. 3 position door 36 acts as a support link between the vehicle and blade 46. Additional linkages between the vehicle and blade 46 are provided by aforementioned hydraulic cylinders 58. Each cylinder 58 has a swingable connection on shaft 44 (FIG. 5). The piston rod 63 for each cylinder 58 has a pivotal connection 65 with blade 46.

Cylinders 58 can be actuated (pressurized or depressurized) to adjust the tilt of blade 46, to prevent earth from escaping over blade edge 52 (FIG. 3 position).

Door 36 and the two hydraulic cylinders 58 form three points of resistance against displacement of blade 46 in the arrow 69 direction (FIG. 3). During bulldozing operations the earth pressure on the blade exerts a force in the arrow 69 direction; door 36 and hydraulic cylinders 58 are oriented to oppose (resist) the arrow 69 forces.

LOADING/UNLOADING THE BOWL (FIGS. 4 AND 5)

When piston rods 61 are fully extended from cylinders 59, and piston rods 63 are fully retracted into cylinders 58, the door and bulldozer blade assume the FIG. 4 positions. Door 36 fits into recess 57 in blade 46, such that the exposed face of the door and the upper (rearward) face 56 of blade 46 are substantially co-planar.

When the vehicle is driven in a rearward direction (arrow 70 in FIG. 4 and 5) edge 52 of blade 46 acts as a shovel to loosen the earth and shift it onto the surface of door 36. The door acts as a ramp to convey the loosened earth into bowl 30.

The earth-removal and earth-loading operations are achieved by driving the vehicle rearwardly in the arrow 70 direction. However, should there be excessive earth accumulations on the surface of door 36 the accumulated earth can be readily transferred into bowl 30 by actuating cylinders 59 to raise door 36 to the FIG. 1 position; earth accumulations on the door surface will be dumped into the bowl. The door-blade assembly can be returned to the FIG. 5 "declining" position for gathering additional earth to be transferred into bowl 30.

It will be seen from FIG. 2 that blade 46 has a transverse width (normal to vehicle centerline 71) that is greater than the transverse width of door 36 (as defined by numeral 13). During a bowl-load operation earth on blade 46 outboard from width dimension 13 will not ordinarily move into bowl 30. To prevent earth on outboard areas of the blade from being deposited into the paths of vehicle tracks 12 the link members 48 may be equipped with earth deflectors 23. The deflectors are shown as metal plates acutely angled to link members 48. The deflectors cause earth on the rear face 21 of blade 46 to be deflectd laterally into bowl 30 and/or outside the paths of tracks 12 (depending on whether there are two plates or only one plate attached to the link member). Each deflector plate may have a twist from its leading edge to its trailing edge to promote the earth deflection process.

Most of the earth on blade 46 is conveyed onto door 57 and into the central space between wall sections 40. The rear areas of wall sections 40 extend rearwardly beyond the end edges 41 of the bowl structure to guide the loosened earth into bowl 30.

Bowl 30 can be unloaded by moving ejector plate 32 from its illustrated position (FIGS. 1 through 4) through stroke distance 34.

GENERAL OPERATION

The vehicle moves cross country or through streams with door 36 in the FIG. 1 upright position. The bowl is sealed against entry of water by reason of gasketry 35 (FIG. 6).

Earth ballast is added to bowl 30 by lowering door 36 and blade 46 to the FIG. 4 condition, and driving the vehicle in the arrow 70 direction. Intermittently the door-blade assembly may be raised to the FIG. 1 position to facilitate movement of earth into bowl 30.

With the added ballast weight the vehicle can be used for bulldozing, with good traction of the tracks 12 on the terrain. Bulldozing is carried out with blade 46 in the FIG. 3 attitude.

With blade 46 in the FIG. 4 position the vehicle can be used for grading purposes. Flat surface 47 of the blade removes minor surface irregularities in the terrain when the vehicle is driven in a forward direction.

The vehicle can be used for hauling earth from place to place. During hauling operations the door-blade assembly is adjusted to the FIG. 1 position. If it becomes necessary to air-lift the vehicle to another location the earth ballast should first be removed from bowl 30, e.g., by operation of ejector 32.

FIG. 7 EMBODIMENT

The door 36, hydraulic cylinders 58 and blade 46 are constructed in the same fashion as previously described. Differences reside in the mechanism used to adjust the door and blade.

Hydraulic cylinders 59*a* are trained between links 64*a* and transverse shaft 49 carried by blade 46. As the cylinders are expanded links 64*a* and 48*a* move to a dashed line position designated by numeral 72. In such a position the blade can be used for bulldozing; the blade is then in the position shown in FIG. 3.

Further expansive movements of cylinders 59*a* shift the linkages to a dashed line position designated by numeral 74; the door-ramp assembly can then be used to load ballast into the cargo bowl (or remove ballast from the bowl).

Figure 7:
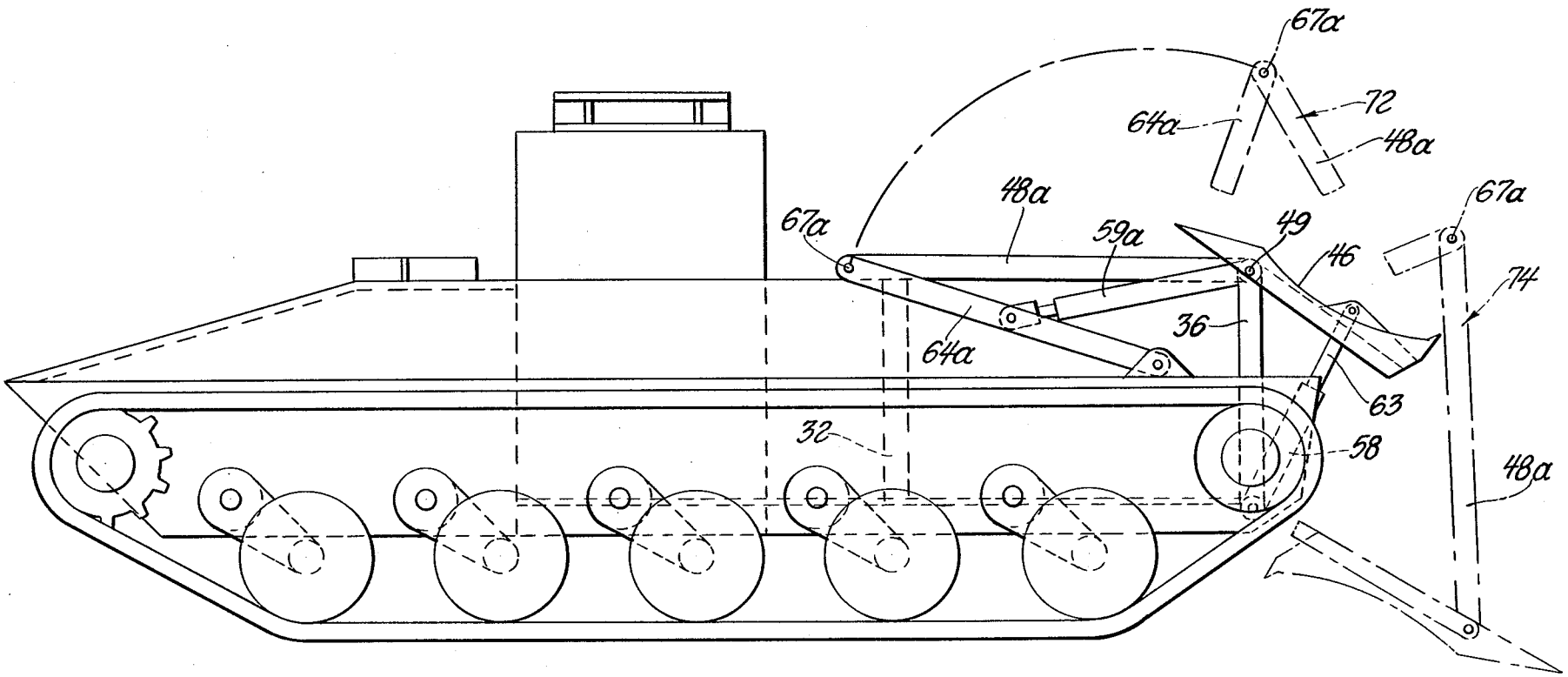
FIG. 7 is a side elevational view of another vehicle embodying the invention.

The FIG. 7 vehicle operates in the same general fashion as the FIG. 1 vehicle.

FIGS. 8 AND 9

Figure 8:
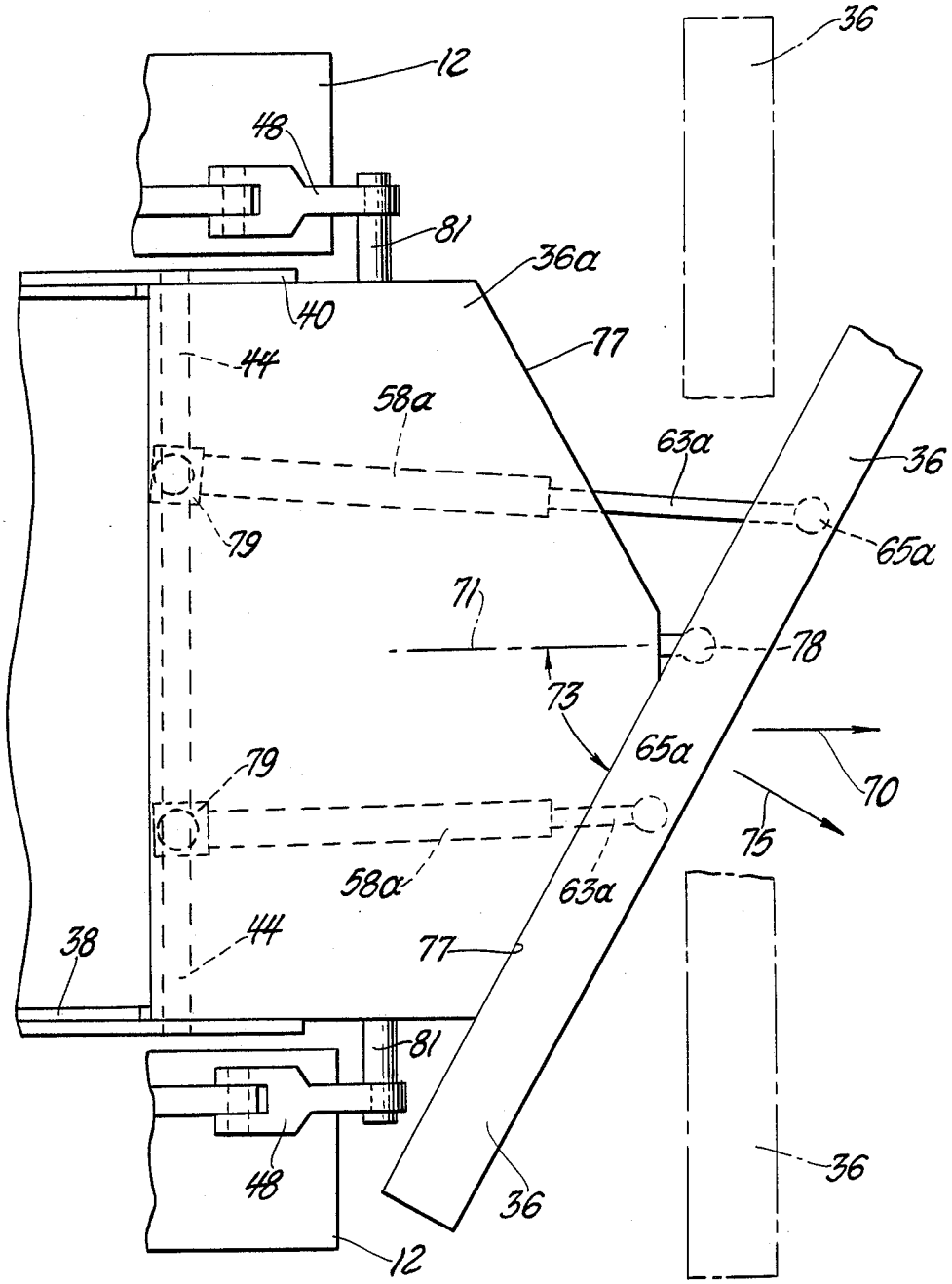
FIG. 8 is a fragmentary top plan view of a further vehicle using the invention.

These FIGS. illustrate a form of the invention wherein the bulldozer blade can be adjusted angularly when it is in its plowing position. FIG. 8 is a top plan view showing blade 46 in the plowing position. In the full line position of the blade (FIG. 8) the general plane of the blade is at an acute angle 73 to the vehicle centerline 71. When the vehicle is driven in the arrow 70 direction blade 46 moves the displaced earth in the arrow 75 direction away from the vehicle path.

Angulation of blade 46 (as shown in FIG. 8) is useful in some trenching operations where it is advantageous to form a continuous mound of earth alongside the area traversed by the vehicle. However, the blade can be adjusted to a standard bulldozer position as shown in dashed lines in FIG. 8.

Adjustment of blade 46 between its full line position and its dashed line position can be accomplished by selectively actuating cylinders 58*a*. As seen in FIG. 8, one cylinder 58*a* is retracted and the other cylinder is extended to achieve an acute angulation of the blade. When cylinders 58*a* have the same effective length the blade is in its normal bulldozer position (dashed lines in FIG. 8).

Door 36*a* has corner areas thereof removed to form chamfer edges 77 that permit blade 46 to take the acutely-angled position. The pivot connection between door 36*a* and blade 46 takes the form of a universal joint 78. The blade can pivot around joint 78 in a vertical plane and also in a horizontal plane (per FIG. 8).

With the FIG. 8 arrangement each cylinder 58*a* changes direction during angular adjustments of blade 46. To accommodate such direction changes the connections between cylinders 58*a* and blade 36 take the form of universal joints 65*a*. Similarly, the pivot connections between cylinders 58 and shaft 44 take the form of universal joints 79.

Figure 9:
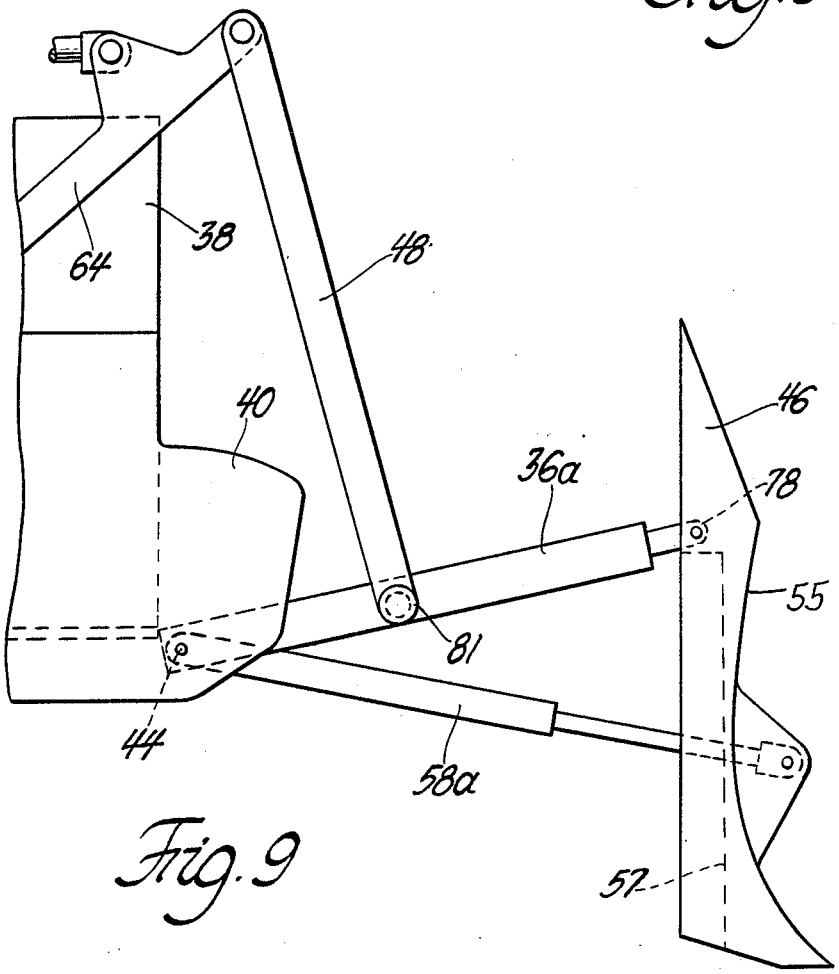
FIG. 9 is a fragmentary side elevational view of the FIG. 8 vehicle.

In the embodiment of FIGS. 8 and 9 the pivotal connection between door 36*a* and each link 48 includes a laterally-extending arm structure 81. Each pivot connection is located at an intermediate point on the door, rather than at the outer edge of the door, as in the FIG. 1 arrangement. The linkage mechanism used in FIG. 9 is generally similar to the linkage mechanism used in FIG. 1.

I wish it to be understood that I do not desire to be limited to the exact details of construction shown and described for obvious modifications will occur to a person skilled in the art, without departing from the spirit and scope of the appended claims.

I claim:

1. An earth-mover vehicle comprising an earth-containment bowl structure having a side opening for earth loading and unloading; a door hingedly connected to a lower portion of the bowl structure for arcuate movement in a vertical plane; a bulldozer blade hingedly connected to the door for movement from a first position wherein the blade is angled to the plane of the door to a second position wherein the blade is folded onto the door; said door being swingable from an upright position closing the bowl side opening to a declining position in which it forms a ramp for passage of earth into or out of the bowl structure; the blade having an edge area that acts as a shovel to shift earth onto the door when the door is in its declining position.

2. The vehicle of claim 1 wherein the door-bowl hinge connection is transverse to the longitudinal centerline of the vehicle, whereby when the door is in a declining position the vehicle can move in the direction of its centerline to enable the blade to shovel earth onto the door and into the bowl.

3. The vehicle of claim 2 wherein the door can take an intermediate level position; said blade being swingable to an upright position for a plowing function when the door is in its intermediate position.

4. The vehicle of claim 3 wherein the blade-door hinged connection is a universal joint that permits the blade to be acutely angled to the vehicle centerline when the blade is in its plowing position.

5. The vehicle of claim 2 wherein the bowl structure has side wall extensions projecting beyond the plane of the door when the door is in its upright position; said wall extensions acting to guide earth into the bowl structure when the vehicle is moving to load the bowl.

6. The vehicle of claim 5 wherein the blade has a transverse width greater than the door width.

7. The vehicle of claim 1 wherein the blade has a recess therein accommodating a portion of the door when the door is in its declining position.

8. The vehicle of claim 7 wherein the recess is of sufficient depth that the exposed face of the door and exposed face of the blade are co-planar when the door is in its declining position.

9. The vehicle of claim 1 and further comprising a first power means for moving the door around its hinged connection with the bowl structure, and a second power means for moving the blade around its hinged connection with the door.

10. The vehicle of claim 9: each power means comprising a fluid cylinder mechanism.

11. The vehicle of claim 1 wherein the blade-door hinged connection is located at the upper edge of the door and at an intermediate point on the blade.

12. An earth-mover comprising: a containment bowl having a side opening; a door swingable about a first axis on the bowl so that the door can alternately serve as a side wall of the bowl or as a ramp to convey earth to the bowl; and a blade swingably connected about a second axis to the door so that the blade can serve a plowing function or serve to shovel material onto the door when the door is acting as a ramp.

13. The vehicle of claim 12 wherein the door is connected to the blade at an intermediate point thereon.

14. The vehicle of claim 12 and further comprising a fluid cylinder mechanism between the door and blade for changing the angulation of the blade relative to the door.

15. The vehicle of claim 14 wherein the fluid cylinder mechanism is essentially level when the blade is in plowing position, whereby said cylinder means resists blade deflection due to earth pressure.

16. The vehicle of claim 14 wherein the fluid cylinder mechanism comprises two laterally-spaced fluid cylinder units spaced in opposite directions from the vehicle centerline; said fluid cylinder units being selectively extendable and retractable to acutely angle the blade relative to the vehicle centerline when the blade is in its plowing position.

17. The vehicle of claim 12 wherein the blade has a recess therein adapted to receive a portion of the door therein when the door is in position to act as a ramp.

18. The vehicle of claim 12 wherein the blade is foldable on the door so that the blade and door form one substantially continuous earth conveyor surface when the door is in position to act as a ramp.

* * * * *